United States Patent [19]

Nakajima

[11] Patent Number: 4,840,323

[45] Date of Patent: Jun. 20, 1989

[54] WEB WINDING AND/OR REWINDING SHAFT STRUCTURE

[76] Inventor: Kiyoji Nakajima, 6-1, Chuo-cho 3-chome, Higashi-Kurume, Tokyo, Japan

[21] Appl. No.: 153,425

[22] Filed: Feb. 8, 1988

[51] Int. Cl.[4] ..... B65H 75/24

[52] U.S. Cl. ..... 242/72 B; 279/2 A

[58] Field of Search ..... 242/72 R, 72 B; 279/2 A

[56] References Cited

U.S. PATENT DOCUMENTS

| | | | |
|---|---|---|---|
| 3,394,902 | 7/1968 | Hise et al. | 242/72 B |
| 3,458,150 | 7/1969 | Cowan | 242/72 B |
| 3,834,257 | 9/1974 | Ganser | 242/72 B X |
| 3,917,187 | 11/1975 | Damour | 242/72 B |
| 3,972,488 | 8/1976 | Lee et al. | 242/72 B |

*Primary Examiner*—Stuart S. Levy
*Assistant Examiner*—Steven M. duBois
*Attorney, Agent, or Firm*—Wenderoth, Lind & Ponack

[57] ABSTRACT

A shaft construction for use in winding or rewinding a web such as a strip of paper, a band of woven cloth, a sheet of metal, and the like around its paper-made core comprises a center hollow shaft having a longitudinal air passage through it, and a plurality of individual hollow expandable annular members mounted around the center hollow shaft and arranged adjacent to each other along the effective length of the center hollow shaft. The annular members are separated by an intervening spacer ring from the adjacent annular members, and each is internally communicative with the center hollow shaft for accepting a compressed air from the center hollow shaft. Each of the annular members engages and press against the paper-made core with a suitable pressure force for maintaining the coaxial relationships between each annular member and the paper-made core.

2 Claims, 3 Drawing Sheets

WEB WINDING AND/OR REWINDING SHAFT STRUCTURE

BACKGROUND OF THE INVENTION

1. Field of the Invention

The present invention relates to the construction of a shaft for use in winding or rewinding webs, such as strips of paper, bands of woven cloth, sheets of metal.

2. Description of the Prior Art

The construction of the conventional web winding or rewinding shaft is shown in FIG. 1. As seen from FIG. 1, the shaft construction includes a central shaft 1 having cone-shaped members 2, 2 at the opposite ends thereof. The cone-shaped members 2, 2 are capable of axial sliding movement. A winding pipe 4, which is usually made of paper, is removably mounted between and held by the cone-shaped members 2, 2 so that the winding pipe 4 can have the coaxial relationship with the center shaft 1. The construction shown in FIG. 1 is typically used when a strip of paper is rolled.

According to the shaft construction as shown in FIG. 1, when a winding pipe 4 is to be mounted to or removed from the center shaft 1, the cone-shaped members 2, 2 must also be removed. This requires the mounting or removing steps for the cone-shaped members 2, 2, which reduces the working effieciency.

More recently an alternative shaft construction has been developed and actually used. This shaft construction employs an air shaft, as shown in FIG. 2. The air shaft construction includes a hollow shaft 5 having a set of lugs 6, 6 extending radially through its wall, and a rubber tube 7 mounted inside the hollow shaft 5. Each of those lugs 6, 6 can project through the hollow shaft outwardly or retract inwardly, under the action of the rubber tube 7. When the rubber tube 7 is supplied with a compressed air, and becomes inflated, it actuates the lugs 6, 6 so that they can move radially outwardly toward a paper winding pipe 4 mounted outside the hollow shaft 5, until they can engage the winding pipe 4. In this way, the winding pipe 4 can be held firmly so that it can be maintained in its coaxial relation to the hollow shaft 5. Usually, the set of lugs 6, 6 consist of four lugs which are mounted at equal intervals around the hollow shaft 5. For a given length of the air shaft construction, one set of the four lugs arranged as described above is arranged at an interval of every one meter along the total effective length of the air shaft construction.

Although the conventional air shaft construction may provide an advantage over that shown in FIG. 1 in that the steps involved in mounting or demounting a winding paper-pipe have been eliminated, and therefore may have been used in a wide range of applications, it has several problems as follows:

(1) As a web, such as a strip of paper or a sheet of metal, is being wound around a winding paper-core, its weight will be increasing to the extent that the holding force of the lugs cannot sustain the overall weight of the web. In that event, the coaxial relationship between the hollow shaft 5 and winding paper-core 4 cannot be maintained, causing the winding paper-core 4 to deviate from the hollow shaft 5, as shown in FIG. 3. When the winding paper-core 4 deviates from the center, the tensional force will be given unevenly to the web being wound. Thus, the result may contain irregularly wound portions of the web, totally or partially.

This may be explained by determining the approximate value of the holding or pushing force that may be provided by the lugs against the winding paper-pipe or core. Then, it is assumed that each one lug has an area of 16 $cm^2$ (2 cm wide and 8 cm long) to be contacted by the rubber tube, and a compressed air of 4 kg/ $cm^2$ is delivered into the tube. The resulting holding or pushing force of the single lug may be obtained as a product of the two parameter values given above, that is 64 kg. Thus, the total holding or pushing force provided by the four lugs that are arranged every one meter along the length of the hollow shaft 5 may be obtained as follows:

$$64\ \text{kg} \times 4\ (\text{lugs}) = 256\ \text{kg}$$

For a web of paper, it is assumed that it has been wound around its core 4 to a diameter of one meter. Its weight (per meter of length) is substantially equal to 500 kg. It may readily be understood from the above equation that the four lugs cannot overcome this weight. In other words, the total holding force of the lugs is not sufficient to prevent the web core from deviating from the center. If the web is a cloth or metal sheet, its total weight per meter of length become much greater, also causing the problem of deviation.

(2) If the deviation occurs as described above, and the hollow shaft is still rotating in that condition, a given lug which is being forced back inwardly under load is moving toward the position occupied by the preceding adjacent lug. The other lugs behave similarly, moving to the position occupied by the preceding adjacent lug. In this manner, each lug is projecting outwardly and retracting inwardly. As this movement is repeated, the portion of the rubber tube that in contacted by those lugs, including the region surrounding that portion, will eventually become worn due to the friction between the rubber tube and lugs, and will also become deformed under the repeated loads, causing the fatigue of the rubber material that may break the rubber tube. This may cause air leaks to occur from the rubber tube.

(3) The pressure of the lugs upon the winding paper-core or pipe is very large (such as approximately 64 kg), as determined from the above equation for the holding or pushing force. For this reason, the winding paper-pipe must have both the thickness and mechanical strength sufficient to sustain or overcome that pressure. Usually, this paper winding core or pipe is supplied for a one-time use, rather than for multiple-time use. Thus, once used, it will become useless. In this respect, it is not economical.

SUMMARY OF THE INVENTION

A principal object of the present invention is to provide a web winding and/or rewinding shaft construction that includes a hollow shaft and a plurality of individual hollow expandable annular members mounted around the hollow shaft. In one preferred embodiment, those individual hollow expandable annular members may be arranged adjacently to each other along the length of the hollow shaft, and each of those members is internally communicative with the hollow shaft.

Furthermore, each individual hollow expandable annular member is separated by an intervening spacer ring from the adjacent member. When a compressed air is delivered into the hollow shaft, the compressed air is distributed through the hollow shaft into each of the individual annular members, which then becomes expanded or inflated. In this case, the inflation or expansion may preferably occur in the circumferential direction of the annular member, rather than in the longitudinal direction of the hollow shaft which may be prevented by the spacer rings.

Each individual hollow expandable annular member may be made of any suitable resileint material, formed like a tire, and may be built to include inner peripheral marginal edges that can engage and press against the corresponding peripheral surface of the hollow shaft. This permits an easy assembly.

The advantages of the present invention will be appreciated from the above brief description as well as from the detailed description of the preferred embodiments that follows herein. According to the web winding and/or rewinding shaft construction of the invention, the amount of the pushing force per a given length of the hollow shaft can be increased because the great number of the individual hollow expandable annular members are arranged adjacent to each other along the effective length of the hollow shaft. As this increased pushing force can be sufficient to overcome the weight or load of any kind of web being wound around the winding paper-core, there will be no problem of the deviation that has occurred with the prior art shaft constructions. As no deviation occurs, each individual hollow expandable annular member will not expand and contract alternatively during the rotation of the shaft construction. It has been described that if any deviation should occur, or the coaxial relationships between the annular members and winding paper-core should not be maintained, the material fatigue or friction would occur, causing the damage or breakage to the annular members from which air leaks would occur. According to the present invention, however, those problems can be eliminated by maintaining the winding paper-core coaxial with the annular members.

The coaxial relationships between the winding paper-core and each of the individual hollow expandable annular members may be achieved by engaging each annular member with the winding paper-core over its corresponding inner peripheral surface of the core and thus supporting it. In this manner, the pressure per unit of the contact area that the winding paper-core will receive from each annular member can substantially be reduced. Thus, any winding paper-core need not be thick, regardless of the kind of webs to be wound. Material and manufacturing costs can be saved.

BRIEF DESCRIPTION OF DRAWINGS

Those and other objects, features, and advantages of the present invention will become apparent from the detailed description of the preferred embodiments that follows by referring to the accompanying drawings, in which.

DESCRIPTION OF THE PREFERRED EMBODIMENTS

Figure 1:
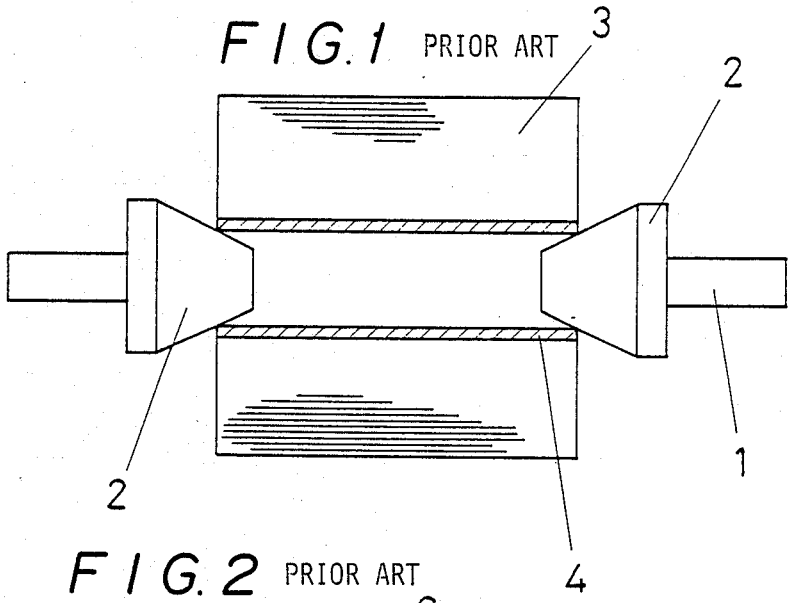
FIG. 1 PRIOR ART
FIG. 1 illustrates a typical prior art shaft construction for the web winding or rewinding, as shown in cross section.
Figure 2:
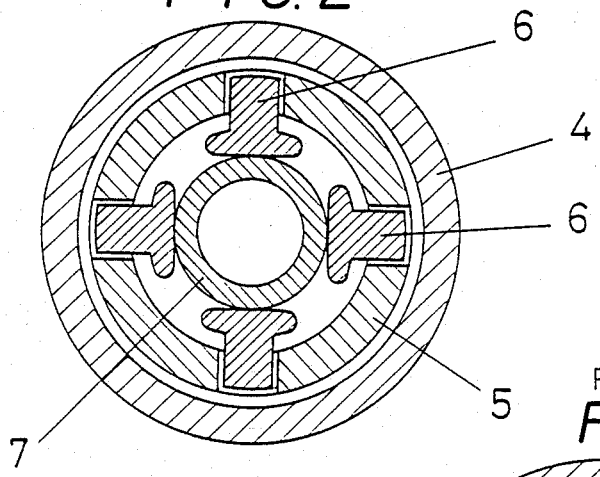
FIG. 2 PRIOR ART
FIG. 2 illustrates another typical prior art shaft construction which employs an air shaft, as shown in cross section.
Figure 3:
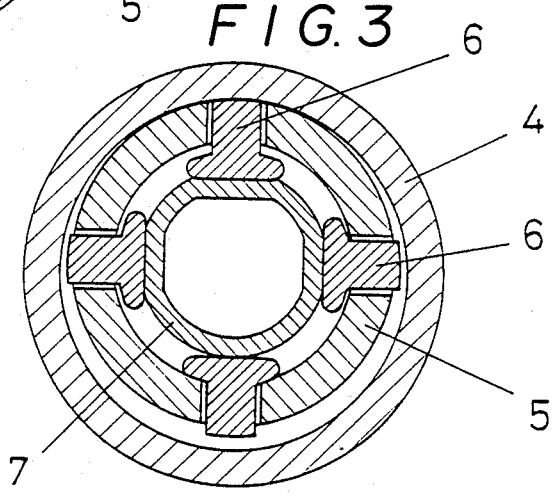
PRIOR ART FIG. 3
FIG. 3 illustrates how the prior art air shaft construction of FIG. 2 is operated, as shown in cross section.
Figure 4:
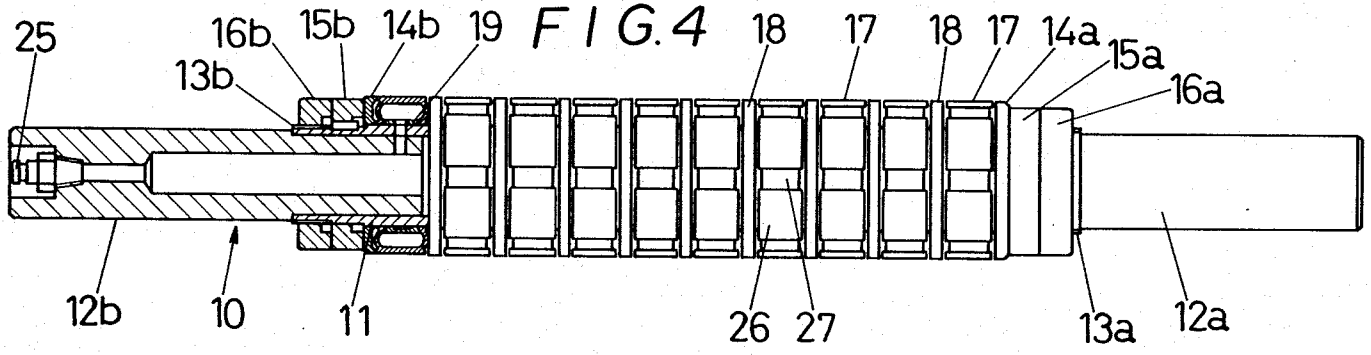
FIG. 4 is a front elevation of a preferred embodiment of the present invention, with its some parts shown in longitudinal cross section.
Figure 6:
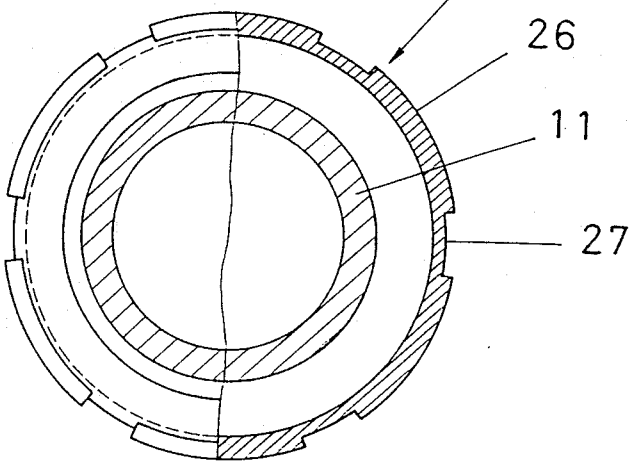
FIG. 6 is a side elevation of the embodiment in FIG. 4 having a hollow expandable annular member shown in cross section.
Figure 5:
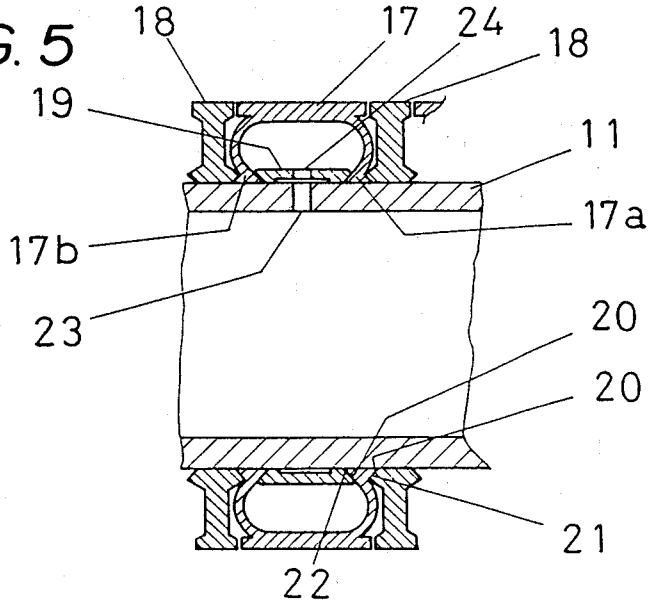
FIG. 5 is partly enlarged section view of the embodiment in FIG. 4.

Referring to FIGS. 4 through 6, there is shown a web winding and/or rewinding shaft construction according to one preferred embodiment of the present invention. The shaft construction includes a center hollow shaft generally designated by 10, which comprises an outer cylindrical casing 11 forming the intermediate portion of the hollow shaft, and a journal shaft 12*a*, 12*b* rigidly mounted on each of the opposite ends of the outer cylindrical casing 11 and extending to the end of the hollow shaft. As it may be seen particularly from FIG. 4, the shaft construction 10 includes other parts or elements that are arranged symmetrically on the opposite side of the outer cylindrical casing 11. At each of the opposite ends of the outer cylindrical casing 11, there is an internally threaded portion 13*a*, 13*b*. On the side of the outer cylindrical casing 11, an end ring 14*a* is mounted, and a combination of a retainer ring 15*a* and a nut 16*a* is provided for preventing the end ring 14*a* from sliding toward the journal shaft 12*a*. Similarly, on the other side, an end ring 14*b* is mounted, and a combination of a retainer ring 15*b* and a nut 16*b* is provided for preventing the end ring 14*b* from sliding toward the journal shaft 12*b*. Between the two end rings 14*a* and 14*b*, there are individual hollow expandable annular members 17 and individual spacer rings 18 which are mounted alternately such that any two adjacent annular members are separated by a spacer ring. Those annular members 17 and spacer rings 18 are placed under an axial thrust load by tightening the nuts 16*a* and 16*b*.

Each individual hollow expandable annular member 17 may preferably be made of any suitable resilient material, such as tire rubber, and may be shaped to provide inner peripheral marginal edges 17*a* and 17*b* between and inside which an internal ring 19 is mounted. Thus, the inner peripheral marginal edges 17*a* and 17*b* for each annular member 17 are held firmly by the internal ring 19 and the spacer ring 18 opposite each of the inner peripheral marginal edges 17*a* and 17*b*, and rest against the corresponding peripheral surface of the outer cylindrical casing 11.

Details of the inner peripheral marginal edges 17*a* and 17*b* for each of the individual hollow expandable annular members 17 are shown in FIG. 5. As shown in FIG. 5, each of the inner peripheral marginal edges is formed to a tapered face 20, 20, and the corresponding inner peripheral marginal edges for the internal ring 19 and spacer ring 18 are also formed to tapered faces 21, 22. When those tapered faces engage against the corresponding ones opposite each other, the axial thrust loads provided by the respective tapered faces force the inner peripheral marginal edges 17*a* and 17*b* for the hollow expandable annular member 17 to press against the corresponding outer peripheral wall of the outer cylindrical casing 11. This keeps the interior of the outer cylindrical casing 11 or hollow shaft 10 hermetic. It may be appreciated that the above tapered faces 20, 20 and 21, 22 opposite each other should engage the corresponding tapered face. This may be achieved by preferably forming those tapered faces at angles of between 10 and 15 degrees in relation to the outer peripheral wall of the outer cylindrical casing 11.

Each of the individual hollow expandable annular members 17 and the longitudinal air passage through the hollow shaft 10 are internally communicative. In order to allow each individual hollow expandable annular member 17 to communicate with the hollow shaft 10, the hollow shaft 10 or outer cylindrical casing 11 has the number of air communicative apertures 23 that corresponds to each individual hollow expandable annular member 17, and the internal ring 19 for each annular member 17 also has an air communicative aperture 24. The journal shaft **12*b* provides an internal longitudinal air passage through it, and includes a check valve plug 25 at the end thereof that controls the delivery or removal of the compressed air into the hollow shaft 10 (through which the compressed air is then distributed into each annular member 17**) or out of it.

As particularly seen from FIG. 6, each individual hollow expandable annular member 17 has thick walls 26 and less thick walls 27 which are formed alternately around the circumferential surface thereof. Those alternate thick and less thick sections are provided for allow each annular member 17 to expand itself easily in the radial or diametrical direction when the compressed air is delivered into it. The thick wall sections can engage the corresponding inner peripheral surfaces of the winding paper core or pipe when the annular member 17 expands itself.

Figure 7:
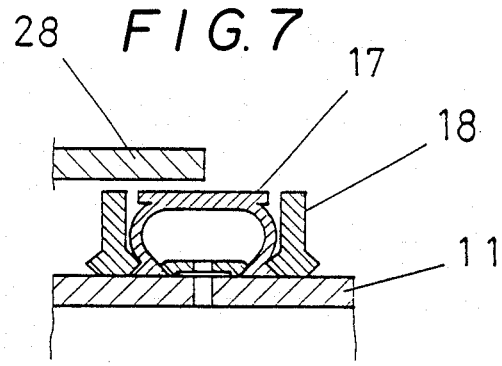
FIGS. 7 and 8 illustrate how the shaft construction embodied in FIGS. 4 through 6 operates.

According to the above described embodiment, each individual hollow expandable annular member 17 is placed in its contracted state before the compressed air is delivered, with its external diameter being substantially equal to that of the spacer ring 18, as shown in FIG. 7. Thus, a winding paper core 28, which will carry or has already carried a web such as paper, cloth, metal sheet, etc., can be readily mounted to the annular members 17 as for the conventional prior art air shaft construction.

Figure 8:
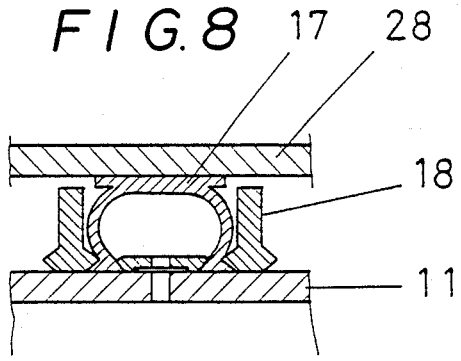

After the winding paper core 28 has been mounted, a compressed air of 4 $kg/cm^2$ is delivered into the hollow shaft 10. Then, each individual hollow expandable annular member 17 expands itself in its radial direction, as shown in FIG. 8. The thick wall sections of the annular members 17 can press against the corresponding inner peripheral wall sections of the winding paper core 28 so that the winding paper core 28 and the hollow shaft 10 can have the coaxial relationships.

The approximate value of the pushing force supplied by one annular member 17 may be calculated in the following manner. That is, for the specific embodiment, it is assumed that each individual hollow expandable annular member 17 is 3 cm wide, with each of its thick periperal wall sections 26 having a length of 3 cm. It is also assumed that twenty-five (25) annular members 17 are provided per meter of length of the hollow shaft 10. Then, one thick wall section 26 provides a pushing force of 36 kg (3 cm×3 cm×4 $kg/cm^2$), and all the annular members 17 may thus provide a total pushing force of 900 kg (36 kg×25) per meter.

It may be appreciated from the above assumption that the annular members can bear the total weight of the web so sufficiently that any physical deformation cannot occur. Thus, the winding paper core 28 can rotate without having any deviation with regard to the annular members 17. It may also be appreciated that each individual hollow expandable annular member 17 provides a relatively small pressure of 36 kg against the winding paper core 28. Thus, a winding paper core 28 can be made thinner.

Figure 9:
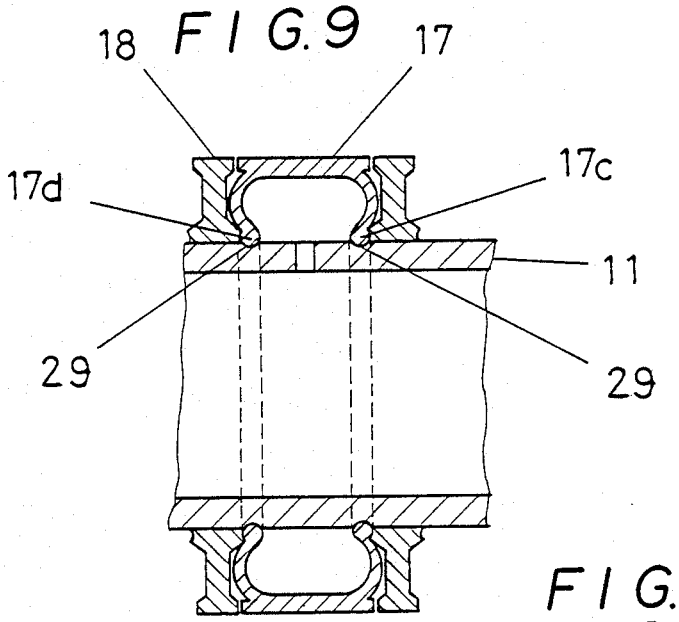
FIG. 9 illustrates a variation according to another preferred embodiment of the present invention, with its parts shown in cross section.

In the above embodiment, it has been described that compressed air may be delivered or removed at the end of the journal shaft **12*b*, but the delivery or removal of the compressed air may be provided at any other appropriate location, such as the longitudinal side of either the journal shaft 12*a* or 12*b* or the outer cylindrical casing 11. The forms of the inner peripheral marginal edges 17*a* and 17*b* for the annular member 17 may also be varied, as shown in FIG. 9. In FIG. 9, the annular member 17 may have its inner peripheral marginal edges 17*c* and 17*d* formed like beads, and the outer cylindrical casing 11 may have annular recesses 29, 29 formed to conform to the forms of the beads 17*c* and 17*d*. In this variation, the inner peripheral marginal edges 17*c* and 17*d* and the annular recesses 29 and 29 can only engage each other by means of the spacer ring 18**.

Figure 10:
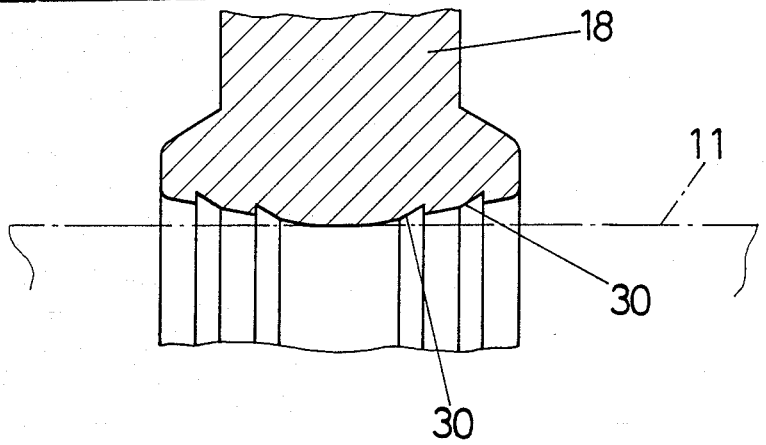
FIG. 10 illustrates another variation including spacer rings having tapered faces, as shown in enlarged cross section.

In the above embodiments and the variations thereof, when each individual hollow expandable annular member 17 is placed under the applied pressure, its inner peripheral marginal edges **17*a*, 17*b* or 17*c*, 17*d* will receive the axial force from the hollow shaft 10. In some cases where the axial force from the hollow shaft is great, therefore, those marginal edges may disengage from the location where the marginal edges are sandwiched between the spacer rings 18 or end rings 14*a*, 14*b* and the outer cylindrical casing 11. To avoid this situation, the tapered faces for the spacer rings 18 and end rings 14*a*, 14*b* may be provided with grooves 30, 30, as shown in FIG. 10**.

As it may be understood from the preceding description, the present invention may advantageously be used for the web winding or rewinding applications. The area over which each individual hollow expandable annular member engage the web winding core can be increased, and the corresponding holding or pushing force against the web winding core can be increased. Thus, the annular members and the web winding core can have coaxial relationships to each other. In addition, each individual hollow expandable annular member expands itself when it accepts the compressed air, and rotates while holding the web being wound. Only a small amount of deformation occurs during the rotation, so that the breakage or damage that might otherwise be caused by the friction or fatigue can be prevented. Furthermore, the pushing or holding force per unit of area of the individual hollow expandable annular members against the winding paper core can be reduced, and therefore the winding paper core can be made thinner.

Although the present invention has been described with reference to the preferred embodiments and the variations thereof, it should be understood that various changes and modifications may be made without departing from the spirit and scope of the invention.

What is claimed is:

1. An expansible mandrel for supporting a winding roll comprising:

a center shaft having a longitudinal air passage therethrough;

a plurality of apertures in said center shaft communicating said air passage with the outer periphery of said center shaft;

an air valve means attached to said air passage for connecting to an air source for supplying air to said air passage and to said plurality of apertures;

a plurality of separate hollow expandable annular members mounted along said center shaft, each one of said plurality of expansible annular members having an air inlet for communicating with one of said plurality of apertures for receiving air supplied by said air passage for expanding each one of said plurality of separate hollow expansible members;

a plurality of spacer rings mounted along said center shaft, each one of said plurality of spacer rings being mounted directly adjacent to and separating adjacent ones of said plurality of expansible annular members, and each one of said plurality of spacer rings having means for fixedly attaching directly adjacent ones of said expansible annular members to said outer periphery of said center shaft;

a plurality of internal rings, each one of said plurality of internal rings being mounted inside one of said plurality of expansible annular members, and each one of said internal rings having clamping means for fixedly attaching each said one of said plurality of annular members to said outer periphery of said center shaft; and wherein, when said plurality of separate hollow expansible annular members is not expanded a winding roll may be slipped over said plurality of annular members and over said plurality of spacer rings, and when said plurality of annular members is then expanded sufficiently for contacting the winding roll by an air source attached to said air passage supplying air thereto a winding roll is rigidly attached to said center shaft by the said plurality of expanded annular members.

2. A device as in claim 1, wherein each one of said plurality of annular members has an internal and an external pair of tapered marginal edges directly adjacent to said outer periphery of said center shaft, said means on said spacer rings for fixedly attaching said annular members to said center shaft includes a pair of tapered surfaces for mating with adjacent ones of said external pairs of tapered marginal edges of adjacent ones of said annular members, and said clamping means of said internal rings for fixedly attaching said annular members to said center shaft includes a pair of tapered surfaces for mating with said internal pair of tapered marginal edges of said annular members.

* * * * *